US005689297A

United States Patent [19]

Yokoyama et al.

[11] Patent Number: 5,689,297

[45] Date of Patent: Nov. 18, 1997

[54] THERMOSENSITIVE STENCIL PRINTER CAPABLE OF CONTROLLING IMAGE DENSITY

[75] Inventors: Yasumitu Yokoyama; Satoshi Kato, both of Kakuda, Japan

[73] Assignee: Tohoku Ricoh Co., Ltd., Miyagi-ken, Japan

[21] Appl. No.: 240,571

[22] Filed: May 11, 1994

[30] Foreign Application Priority Data

May 11, 1993 [JP] Japan ..... 5-109341
Aug. 18, 1993 [JP] Japan ..... 5-204272

[51] Int. Cl.[6] ..... B41J 2/36; B41J 2/37; B41J 2/365

[52] U.S. Cl. ..... 347/188; 347/193; 347/194

[58] Field of Search ..... 101/114, 128.4, 101/128.21; 347/7, 14, 17, 171, 183, 188, 196, 206, 193, 194; 400/120.01, 120.09, 120.13

[56] References Cited

U.S. PATENT DOCUMENTS 4,400,705 8/1983 Horike ..... 347/14
4,573,059 2/1986 Shinma et al. ..... 347/178
5,195,832 3/1993 Fujikawa et al. ..... 400/120.13
5,223,853 6/1993 Wysocki et al. ..... 347/14
5,361,090 11/1994 Suzuki et al. ..... 347/17

FOREIGN PATENT DOCUMENTS 59-95167 6/1984 Japan .
1206673 3/1985 Japan ..... 347/188
673 11/1985 Japan ..... 347/188
63-51158 3/1988 Japan .
64-55262 3/1989 Japan .
2-70493 3/1990 Japan .
2-151473 6/1990 Japan .
2-245371 10/1990 Japan .

*Primary Examiner*—Benjamin R. Fuller
*Assistant Examiner*—L. Anderson
*Attorney, Agent, or Firm*—Oblon, Spivak, McClelland, Maier & Neustadt, P.C.

[57] ABSTRACT

In a thermosensitive stencil printer, a sensor responsive to the temperature of a thermal head and at least either of a sensor responsive to the temperature of ink and keys for entering a desired image density are provided. Cutting energy to be applied to the head is controlled on the basis of ink temperature and head temperature, thereby maintaining image density constant without regard to changes in ink temperature. The density of a printing is easily variable to desired density.

17 Claims, 6 Drawing Sheets

Fig. 2A
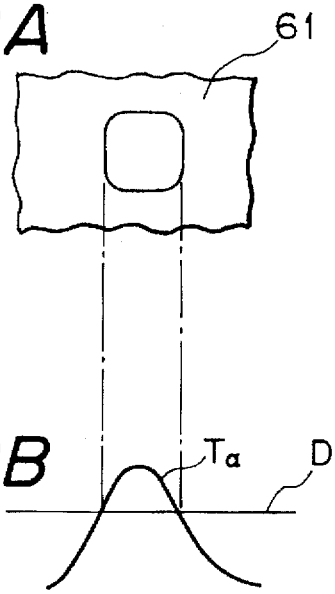
Fig. 2B
Fig. 2C
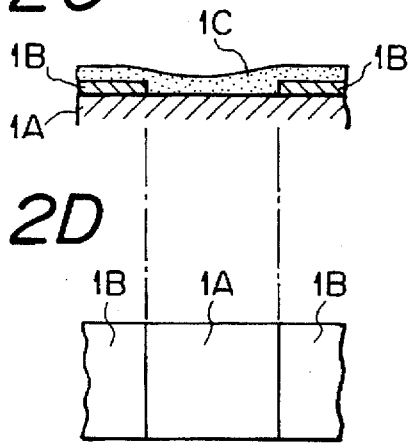
Fig. 2D
Fig. 2E
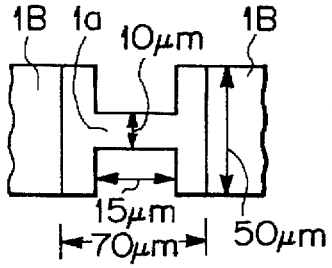
Fig. 3A
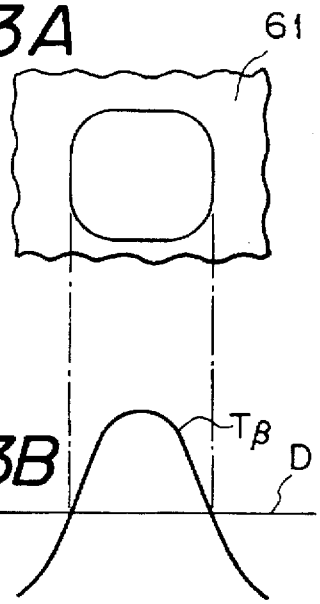
Fig. 3B
Fig. 3C
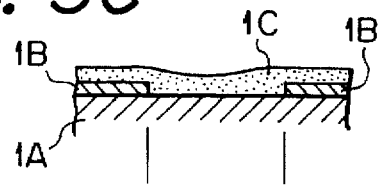
Fig. 3D
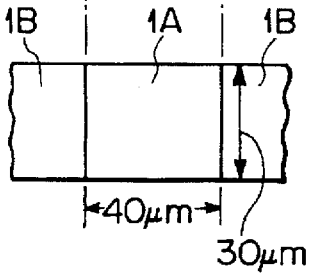

THERMOSENSITIVE STENCIL PRINTER CAPABLE OF CONTROLLING IMAGE DENSITY

BACKGROUND OF THE INVENTION

1. Field of the Invention

The present invention relates to a thermosensitive stencil printer capable of controlling the density of an image to be printed on a sheet. More particularly, the present invention relates to a device for controlling image density which changes with a change in the temperature and, therefore, fluidity of ink, and a device for setting up any desired image density by correcting image density.

2. Discussion of the Background

A thermosensitive stencil printer cuts a pattern representative of a desired image in a stencil, wraps the cut stencil, or master, around a print drum, and then supplies ink from the inner periphery of the drum, i.e., the rear of the master. As a result, the ink penetrates the master through the cut pattern to transfer the pattern to a sheet. Generally, ink for use with such a printer has fluidity which changes with a change in temperature. Specifically, the fluidity of ink decreases (i.e. ink hardens) as the ink temperature lowers, while the former increases (i.e. ink softens) as the latter rises. Relatively cold and, therefore, low fluidity ink is difficult to pass through the cut portions or perforations of the master. Should such ink be used for printing, the density of the resulting image on a sheet would be short. Conversely, should relatively hot and, therefore, high fluidity ink be used, the resulting image density would be excessively high, i.e., the resolution of the image would be low.

In light of the above, Japanese Patent Laid-Open Publication No. 2-151473, for example, discloses an implementation for controlling the density of printings by adjusting the pressure for pressing a master and a sheet against each other mechanically. Also, Japanese Patent Laid-Open Publication No. 2-245371 teaches an arrangement for changing the speed at which a sheet passes through the section where a master and a sheet are pressed against each other, i.e., printing speed. However, with the mechanical adjustment scheme, it is not easy to adjust the pressure by mechanical means delicately. The printing speed scheme has a drawback that changing printing speed mechanically is not practicable without resorting to the troublesome adjustment of the entire printer sequence.

A change in the density of a printed image is attributable not only to a change in the temperature and, therefore, fluidity of ink, but also to a change in the temperature of the head itself. Moreover, the image density changes due to the aging of various constituent parts of the printer as well as to the kinds, materials and adaptability of ink and sheets used. It is, therefore, desirable to maintain a desired density by correcting a change in density without regard to the cause of the change. However, a printer having such a capability has not been reported yet.

SUMMARY OF THE INVENTION

It is, therefore, an object of the present invention to provide a thermosensitive stencil printer capable of providing an image with constant density without regard to ink temperature.

It is another object of the present invention to provide a thermosensitive stencil printer capable of providing an image with any desired density even when image density changes.

It is another object of the present invention to provide a generally improved thermosensitive stencil printer capable of controlling image density.

In accordance with the present invention, a device included in a thermosensitive stencil printer for controlling the density of an image to be formed on a sheet via a thermal head in association with a change in the temperature of ink comprises an ink temperature sensor for sensing the temperature of the ink and outputting a corresponding ink temperature signal, and a controller responsive to the ink temperature signal for adjusting cutting energy to be applied to a the thermal head to predetermined energy on the basis of the sensed ink temperature, thereby controlling the density of the image.

Also, in accordance with the present invention, a device included in a thermosensitive stencil printer for providing an image formed on a sheet via a thermal printer with a desired density comprises a density setting section for outputting a set density signal representative of a value selected for providing the image with a desired density, and a controller responsive to the set density signal for adjusting cutting energy to be applied to the thermal head to a predetermined energy, thereby controlling the density of the image to the desired density.

BRIEF DESCRIPTION OF THE DRAWINGS

The above and other objects, features and advantages of the present invention will become more apparent from the following detailed description taken with the accompanying drawings in which:

FIGS. 2A–2E and 3A–3D show a relation between cutting energy to be applied to a thermal head and the size of a perforation, together with their influence on each other;

DESCRIPTION OF THE PREFERRED EMBODIMENTS

Figure 1:
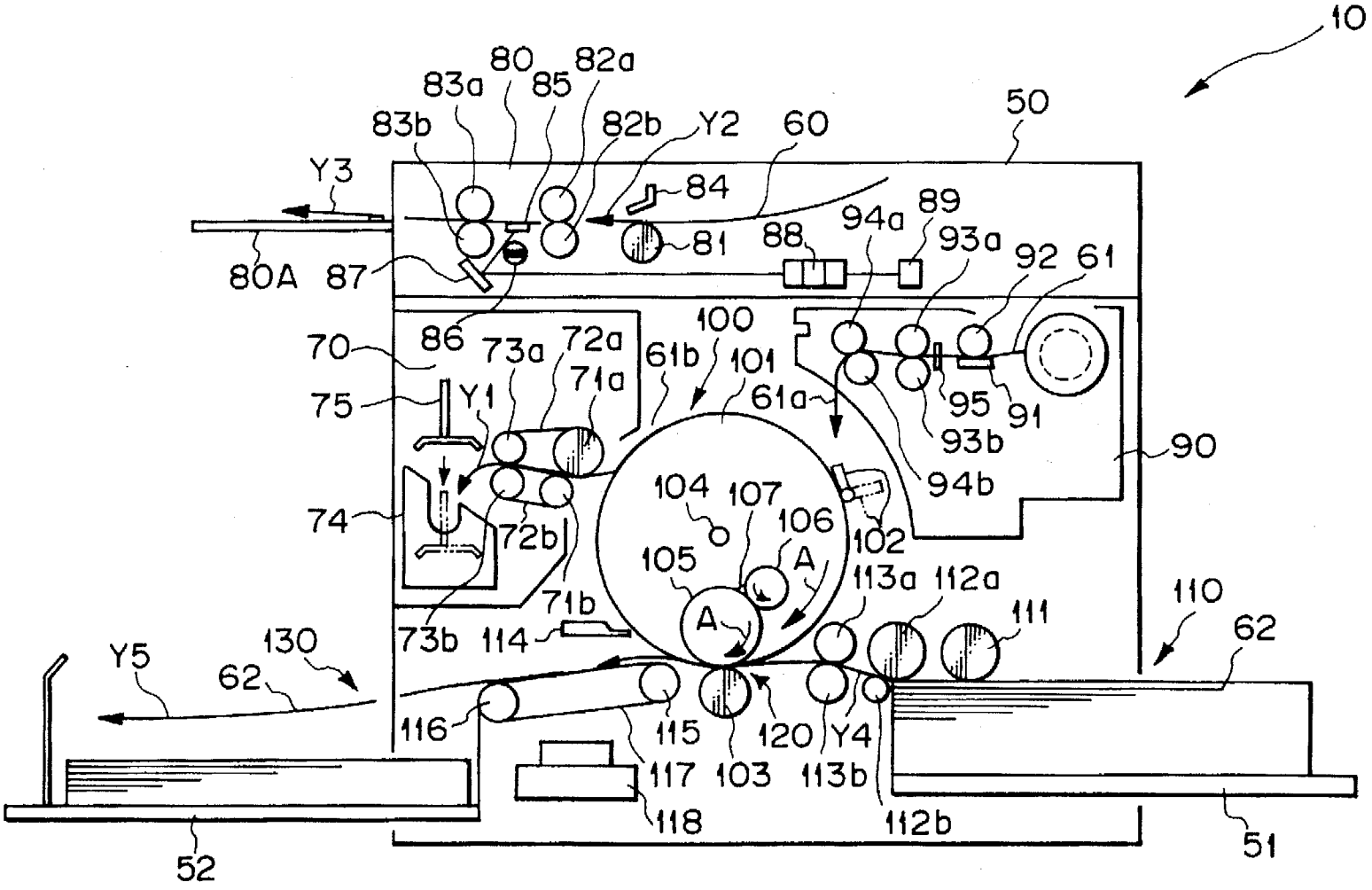
FIG. 1 is a section of a thermosensitive stencil printer to which the present invention is applied.

Referring to FIG. 1 of the drawings, a thermosensitive stencil printer to which the present invention is applied is shown. As shown, the printer, generally 10, has a housing or cabinet 50. A document reading section 80 is disposed in an upper portion of the housing 50. A master making and feeding section 90 is positioned below the reading section 80 and at the right-hand side, as viewed in FIG. 1. A print drum section 100 is located at the lower center of the housing 50 and includes a porous print drum 101. A master collecting section 70 is disposed at the left of the print drum section 100. A sheet feeding section 110 is provided below the master making section 90. A pressing section 120 is located below the print drum 101. Further, a sheet discharging section 130 is positioned at the lower left-hand side of the housing 50.

The operation of the printer 10 will be described together with a more specific arrangement of the printer 10. To begin with, a document 60 carrying a desired image thereon is laid on a document table, not shown, provided on the top of the reading section 80. In this condition, a master start key provided on an operation panel, although not shown in FIG. 1, is pressed to start a master making operation. This operation begins with a master discharging procedure. Specifically, at the time when the start key is pressed, a master 61*b* used last time is still left on the print drum 101. Hence, in the master discharging procedure, the print drum 101 is rotated counterclockwise, as viewed in the figure, while carrying the master 61*b* thereon. As the trailing edge of the master 61*b* approaches a pair of separator rollers 71*a* and 71*b*, it is picked up by one separator roller 71*a*. A pair of conveyor belts 72*a* and 72*b* are respectively passed over the separator roller 71*a* and a discharge roller 73*a* and over the the separator roller 71*b* and a discharge roller 73*b*. The discharge rollers 73*a* and 73*b* are located at the left of the rollers 71*a* and 71*b* in a pair. The master 61*b* picked up by the roller 71*a* is conveyed by the pair of belts 72*a* and 72*b* in a direction indicated by an arrow Y1 until it has been collected in a box 74. This is the end of the master discharging procedure. At this instant, the print drum 101 is continuously rotated counterclockwise. The master 61*b* collected in the box 74 is compressed within the box 74 by a presser 75.

In parallel with the master discharging procedure, the reading section 80 reads the document 60. Specifically, the document 60 is sequentially conveyed from the document table in directions Y2 and Y3 by a separator roller 81, a front conveyor roller pair 82*a* and 82*b*, and a rear conveyor roller pair 83*a* and 83*b*, while being read by optics. When a plurality of documents are stacked on the table, only the lowermost document is fed out by being separated from the others by a blade 84. Specifically, as a lamp 86 illuminates the document 60 being conveyed over a glass platen 85, the resulting imagewise reflection from the document 60 is reflected by a mirror 87 and is then incident to an image sensor 89 via a lens 88. The image sensor 89 is implemented by CCDs (Charge Coupled Devices). In this way, the document 60 is read by a conventional reduction type scanning system. The document 60 read by the image sensor 89 is driven out to a tray 80A. The image sensor 89 converts the light incident thereto to a corresponding electric signal and sends it to an analog-to-digital converter (ADC), not shown, which is disposed in the housing 50. The ADC transforms the input electric signal to a digital image signal.

Further, in parallel with the reading operation stated above, a master making and feeding procedure is executed on the basis of the digital image signal or image data. A thermosensitive stencil 61 is implemented as a roll and set in a predetermined position inside of the master making and feeding section 90. In the procedure to be described, the leading edge of the stencil 61 is paid out from the roll and passed through between a thermal head 91 and a platen roller 92. Then, the stencil 61 is driven by a feed roller pair 93*a* and 93*b* and another roller pair 94*a* and 94*b* to the outer periphery of the print drum 101. The head 91 cuts the stencil 61 being conveyed, thereby producing a master 61*a*. Specifically, the head 91 has an array of small heating portions, not shown. The heating portions selectively heat in response to the digital image signal from the ADC. As a result, the portions of the stencil 61 contacting such heating portions are melted and cut by heat. As a result, the image data representative of the document 60 is formed in the stencil 60 as a perforation pattern, whereby a master 61*a* is produced. The stencil 61 is 40 μm thick in total and made up of Japanese paper, which is a porous base, and a 2 μm thick thermoplastic resin film adhered thereto.

The leading edge of the master 61*a* is conveyed by the master feed roller pair 94*a* and 94*b* toward the periphery of the print drum 101. Then, the leading edge of the master 61*a* is steered by a guide member, not shown, to move downward or hand toward a master clamper 102. At this instant, the master clamper 102 is held in an open position, as indicated by a dash-and-dots line in FIG. 1. Also, the master 61*b* used last time has already been removed from the print drum 101 by the previously stated procedure. The leading edge of the master 61*a* is clamped by the master clamper 102 at a predetermined timing. In this condition, the print drum 101, rotating in a direction A (clockwise), causes the master 61*a* to sequentially wrap therearound. A cutter 95 cuts the trailing edge of the master 61*a* at a predetermined length. The master making and feeding procedure ends when the master sheet 61*a* provided with one page of image or a plurality of pages of images is fully wrapped around the print drum 101.

In the above condition, a printing procedure begins. Sheets 62 are stacked on a sheet feed tray 51. The lowermost one of the sheets 62 is picked up by a pick-up roller 111 and a separation roller pair 112*a* and 112*b* and fed toward a feed roller pair 113*a* and 113*b* in a direction indicated by an arrow Y. The feed roller pair 113*a* and 113*b* drives the sheet 62 to the pressing section 120 at a predetermined timing synchronous with the rotation of the print drum 101. When the sheet 62 arrives at the gap between the print drum 101 and a press roller 103, the roller 103 is raised to press the sheet 62 against the master 61*a* wrapped around the drum 101. As a result, ink is transferred from the porous portion of the print drum 101 to the sheet 62 via the perforation pattern of the master 61*a*, thereby forming an image on the sheet 62. Specifically, in the print drum 101, ink is fed from a ink supply tube 104 to an ink well formed between an ink roller 105 and a doctor roller 106. The ink roller 105 is rotated in the same direction as and in synchronism with the print drum 101 while being held in contact with the inner periphery of the drum 101. Hence, the ink roller 105 feeds the ink to the inner periphery of the drum 101. The ink is implemented by a W/O type emulsion ink.

The sheet 62 carrying the image thereon is separated from the print drum 101 by a separator in the form of a blade 114. A conveyor belt 117 is passed over an inlet roller 115 and is an outlet roller 116 and rotated counterclockwise. In this condition, the sheet 62 separated from the drum 101 is conveyed by the belt 117 toward the sheet discharging section 130 while being sucked by a fan 118. In this way, the consecutive sheets, or printings, 62 are sequentially stacked on the tray 52. This completes so-called trial printing.

After the trial printing, the operator enters a desired number of printings on numeral keys, not shown, also provided on the operation panel and then presses a print start key, not shown. Then, the sheet feeding, printing and sheet discharging steps are repeated in the same order as during trial printing a number of times corresponding the desired number of printings.

A reference will be made to FIGS. 2A–2E and 3A–3D for describing a relation between cutting energy applied to each heating portion of the head 91, i.e., the temperature of each heating portion, and the size of the resulting perforation.

FIGS. 2C and 3C show a common structure representative of a small heating portion included in the head 91. As shown, the heating portion has a heating layer 1A implemented by a substance having high electric resistance, lead electrodes 1B, and a protective film 1C. The heating layer 1A is formed on a substrate which is indicated by hatching in the figures. When a voltage is applied to between the lead electrodes 1B, a current flows through a part of the heating layer 1A intervening between the lead electrodes 1B, causing such a part of the heating layer 1A to heat due to Joule heat. Such small heating portions are arranged in the head 91 at a constant pitch in a direction perpendicular to the sheet surface of FIGS. 2C and 3C, i.e., in the main scanning direction. The stencil 61 is conveyed in the right-and-left direction, or subscanning direction, of the head 91 and cut to form the master 61.

When the heating layer 1A is rectangular, as shown in FIG. 3D, it may be sized 30 μm in the main scanning direction and 40 μm in the subscanning direction. As shown in FIG. 2E, assume that the heating layer 1A is provided with a reduced portion 1*a* at the center thereof so as to increase current density thereat, i.e., to cause heat to concentrate thereat. Then, the heating layer 1A may be sized 50 μm in the main scanning direction and 70 μm in the subscanning direction, while having the reduced portion 1*a* sized 10 μm in the main scanning direction and 15 μm in the subscanning direction.

When cutting energy in the form of electric energy is applied to such a heating portion of the head 91, it is transformed to thermal energy by the heating layer 1A. As a result, the stencil 61 contacting the protective layer 1C is heated. At this instant, the temperature of the stencil 61 has a convex distribution, as indicated by a curve Tα in FIG. 2B or a curve Tβ in FIG. 3B. Specifically, FIGS. 2B and 3B respectively show a case wherein cutting energy fed to the heating portion is relatively small and a case wherein it is relatively great. In FIGS. 2B and 3B, a line D is representative of a threshold temperature at which the thermoplastic resin of the stencil 61 is perforated. The perforation is relatively small, as shown in FIG. 2A, or relatively great, as shown in FIG. 3A, depending on cutting energy applied to the heating portion.

The present invention adjusts the energy to be applied to the individual heating portions of the head 91, i.e., the size of a small perforation which is a unit of a pattern to be formed in the stencil 61. This is successful in controlling the density of an image to be printed on a sheet. This is true with both the rectangular configuration shown in FIG. 3D and the heat concentrating configuration shown in FIG. 2E. More specifically, the image density is determined by the amount of ink penetrating the master 61*a*, which is, in turn, substantially proportional to the area of the individual perforations constituting a perforation pattern. It follows that image density will be high when the perforation size is great or low when it is small. Stated another way, image density depends on the perforation size which, in turn, depends on the cutting energy. Therefore, a particular relation exists between the image density and the cutting energy and can be determined by experiments.

Image density is determined by the amount of ink penetrating the master 61*a*, as stated above. Since the fluidity of ink changes with a change in temperature, the amount of ink penetrating the master 61*a* changes with a change in fluidity. Specifically, when temperature is low, the ink will be difficult to pass through the perforations of the master 61*a* due to low fluidity. By contrast, when temperature is high, fluidity will be high enough to allow the ink to pass through the perforations easily. It follows that image density also depends on the fluidity or temperature of the ink. Hence, images of desired density are achievable if the individual perforations of the master 61*a* are increased in size when ink temperature is low or if they are reduced in size when ink temperature is high. As a result, a particular relation also holds between the ink temperature and the cutting energy and can be determined by experiments.

In light of the above, the present invention adjusts, based on the particular relation between the ink temperature and the cutting energy determined by experiments, the cutting energy such that a perforation pattern has an adequate perforation size matching the ink temperature.

Most of the heat generated by each heating portion of the head 91 is consumed in melting and cutting the stencil 61. However, a part of the heat is transferred to the body of the head 91 and heats it. While this, of course, does not heat the head 91 to a noticeable degree, the head 91 will be heated to a certain degree when, for example, continuously operated for a long period of time. Then, it is likely that the heat of the head body is added to the cutting energy as a bias, resulting in perforations whose size is greater than expected. This cannot be coped with when the cutting energy alone is adjusted in matching relation to ink temperature. Considering such an occurrence, the present invention corrects cutting energy matching ink temperature on the basis of the temperature of the head itself.

Figure 4:
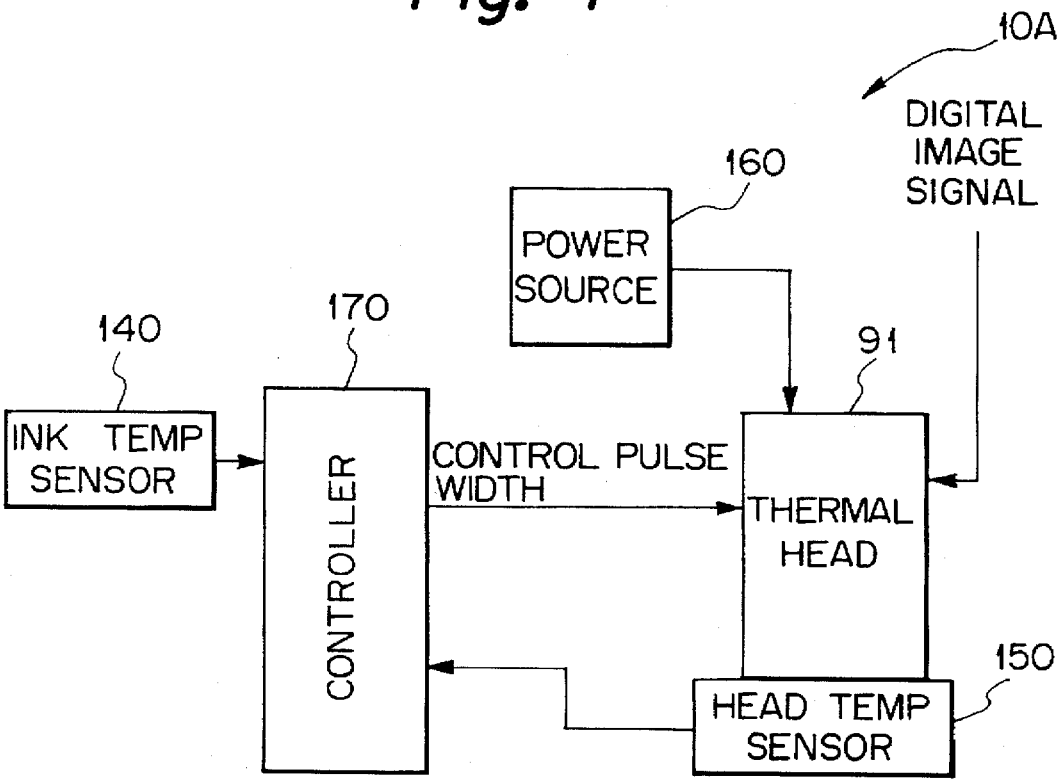
FIG. 4 is a block diagram schematically showing an image density control device embodying the present invention.
Figure 5:
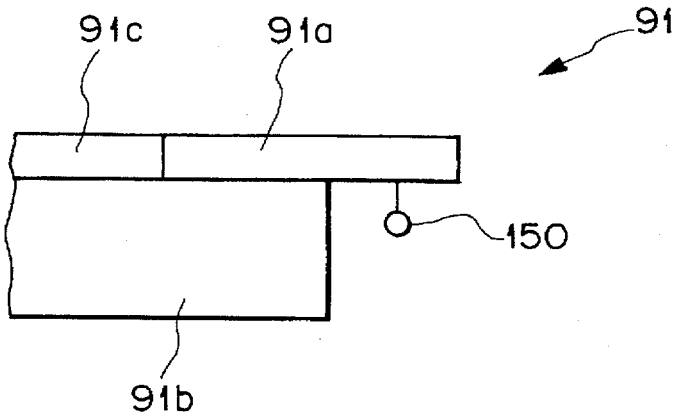
FIG. 5 is a side elevation showing a position where a head temperature sensor is located.

Referring to FIGS. 4 and 5, an image density control device embodying the present invention will be described hereinafter. Briefly, the embodiment controls the density of an image which changes with a change in the temperature and, therefore, fluidity of ink. As shown in FIG. 4, the control device, generally 10A includes an ink temperature sensor 140 implemented by, for example, a thermistor for sensing ink temperature. A head temperature sensor 150 is responsive to the temperature of the head 91 and is also implemented by a thermistor by way of example. A power source 160 feeds power to the head 91 to generate cutting energy at the heating portions thereof. A microprocessor or similar controller 170 adjusts the cutting energy of the head 91 in response to the outputs of the sensors 140 and 150. The head 91 receives the previously mentioned digital image signal from the ADC.

The controller or microprocessor 170 includes a CPU (Central Processing Unit), a ROM (Read Only Memory), an I/O (Input/Output) port, etc. The ROM stores a program for adjusting cutting energy, and a relation between the ink temperature and head temperature and the cutting energy for forming perforations of optimal size matching such temperatures. This relation is determined by experiments beforehand. The ink temperature sensor 140 senses the temperature of ink in the ink well 107 formed in the print drum 101, FIG. 1. As shown in FIG. 5, the head temperature sensor 150 is positioned on a head base 91*a* or within an aluminum radiator 91*b*. In FIG. 5, the reference numeral 91*c* designates a portion accommodating the heating portions.

For the adjustment of cutting energy, the current or the voltage to be applied to each heating portion of the head 91 in response to the digital image signal may be changed. However, the illustrative embodiment adjusts it by changing the width of control pulses to be applied to the heating portions of the head 91. Specifically, in response to the outputs of the sensors 140 and 150, the microprocessor 170 controls the head 91 by setting up a particular pulse width capable of forming perforations of adequate size in the stencil 61. While the power source supplies power to the head 91, the head 91 causes the heating portions thereof to selectively heat in accordance with the digital image signal and the pulse width set up by the microprocessor 170.

In the embodiment, the stencil 61 is 40 μm thick and consists of a porous substrate implemented by Japanese paper, and a 2 μm thick thermoplastic resin film adhered to the substrate. It was found by experiments that when the width of pulses to be applied to the heating portions of the head 91 is changed in matching relation to the head temperature and ink temperature, desirable images having constant density are achievable without regard to changes in ink temperature.

When series of experiments were conducted by use of a head having a resolution of 400 dots per ink (dpi) and heating portions which were sized 30 by 30 μm and had a line period of 3 ms/line, the head temperature did not change. In such a condition, the pulse width may be adjusted only on the basis of ink temperature. Assume that cutting energy is set up only on the basis of ink temperature, as stated above, and that ink temperature is 10° C., 20° C. and 30° C. Then, specific pulse widths, ink viscosities (flow values as prescribed by JIS-K5701), perforation sizes and image densities listed in Table 1 shown below hold. The image densities were measured in terms of reflection densities by using a Macbeth densitometer.

TABLE 1

| INK TEMP | 10° C. | 20° C. | 30° C. |
|---|---|---|---|
| PULSE WIDTH (μS) | 600 | 530 | 460 |
| INK DENSITY (mm) | 27.8 | 29.5 | 32.2 |
| PERFORATION SIZE (μm) | 55 | 52 | 48 |
| IMAGE DENSITY | 0.95 | 0.95 | 0.95 |

As Table 1 indicates, image density remains the same without regard to ink temperature, insuring a desirable image at all times.

Figure 6:
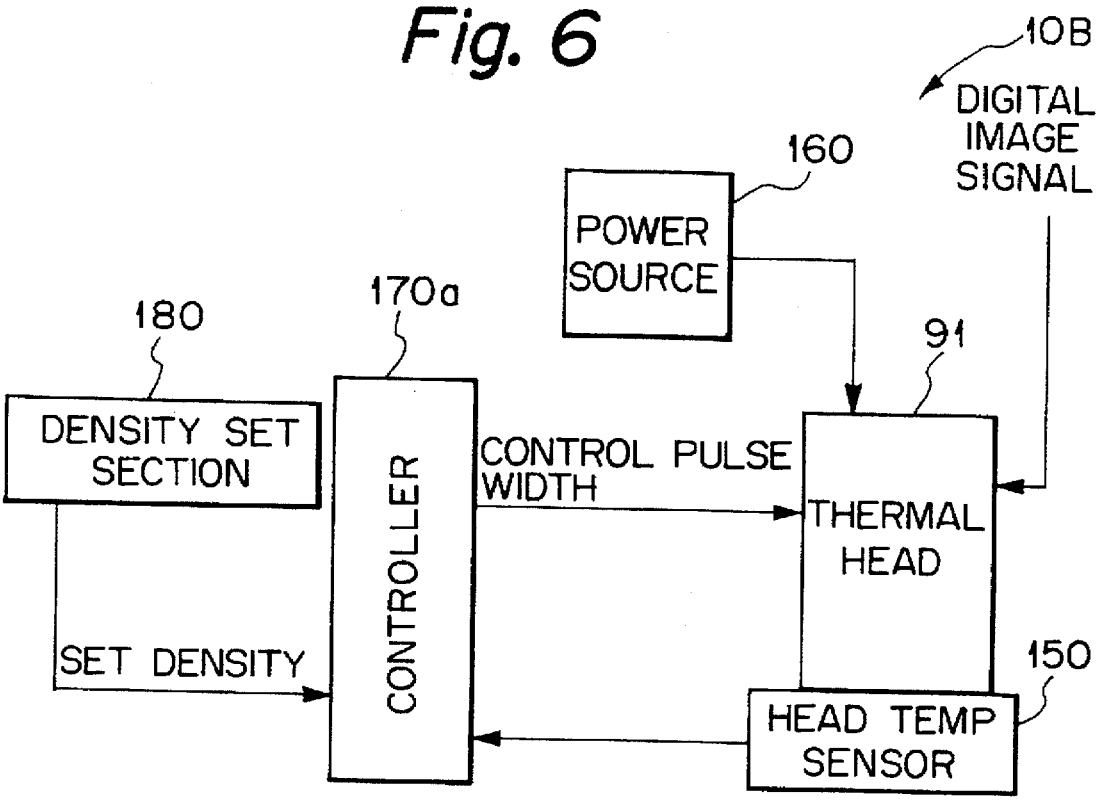
FIG. 6 is a block of an image density setting device representative of an alternative embodiment of the present invention.
Figure 7:
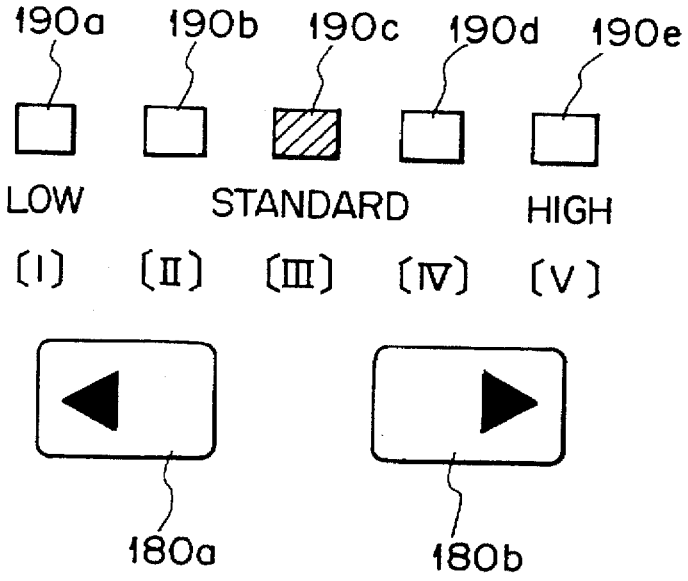
FIG. 7 is a plan view showing density keys accessible for changing image density.

A reference will be made to FIGS. 6–9 for describing an alternative embodiment of the present invention. This embodiment is capable of correcting image density in order to set up a desired image density. As shown in FIG. 6, a density setting device 10B is shown which is essentially similar to the device 10A of FIG. 4 except for the following. The device 10B has, in place of the ink temperature sensor 140 of the device 10A, a density setting section 180 which is accessible for entering a desired image density. As shown in FIG. 7, the density setting section 180 includes two density keys **180*a* and 180*b* arranged on the operation panel. With the density keys 180 and 180*b*, there are available five different densities, i.e., the lowest density [I] to the highest density [V] via a standard density [III]. LEDs (Light Emitting Diodes) 190*a*–190*e* are associated with the density keys 180*a* and 180*b*** to indicate the five stepwise densities, respectively.

Signals from the density keys **180*a* and 180*b* and head sensor 150 are fed to the I/O port of a microprocessor 170*a***. Again, a ROM included in the microprocessor stores a program for adjusting cutting energy, and a relation between the ink temperature and head temperature and the cutting energy for forming perforations of optimal size matching such temperatures. This relation is determined by experiments beforehand.

The alternative embodiment, like the previous embodiment, adjusts cutting energy by changing the width of pulses to be applied to the heating portions of the head 91. Specifically, on detecting an image density set by the keys **180*a* and 180*b* and the output of the head temperature sensor 150 as well as the head temperature, the microprocessor 170 controls the head 91 by setting up a particular control pulse width capable of forming perforations of adequate size in the stencil 61. While the power source 160 supplies power to the head 91, the head 91 causes the heating portions thereof to selectively heat in accordance with the digital image signal and the pulse width set up by the microprocessor 170*a***.

Figure 8:
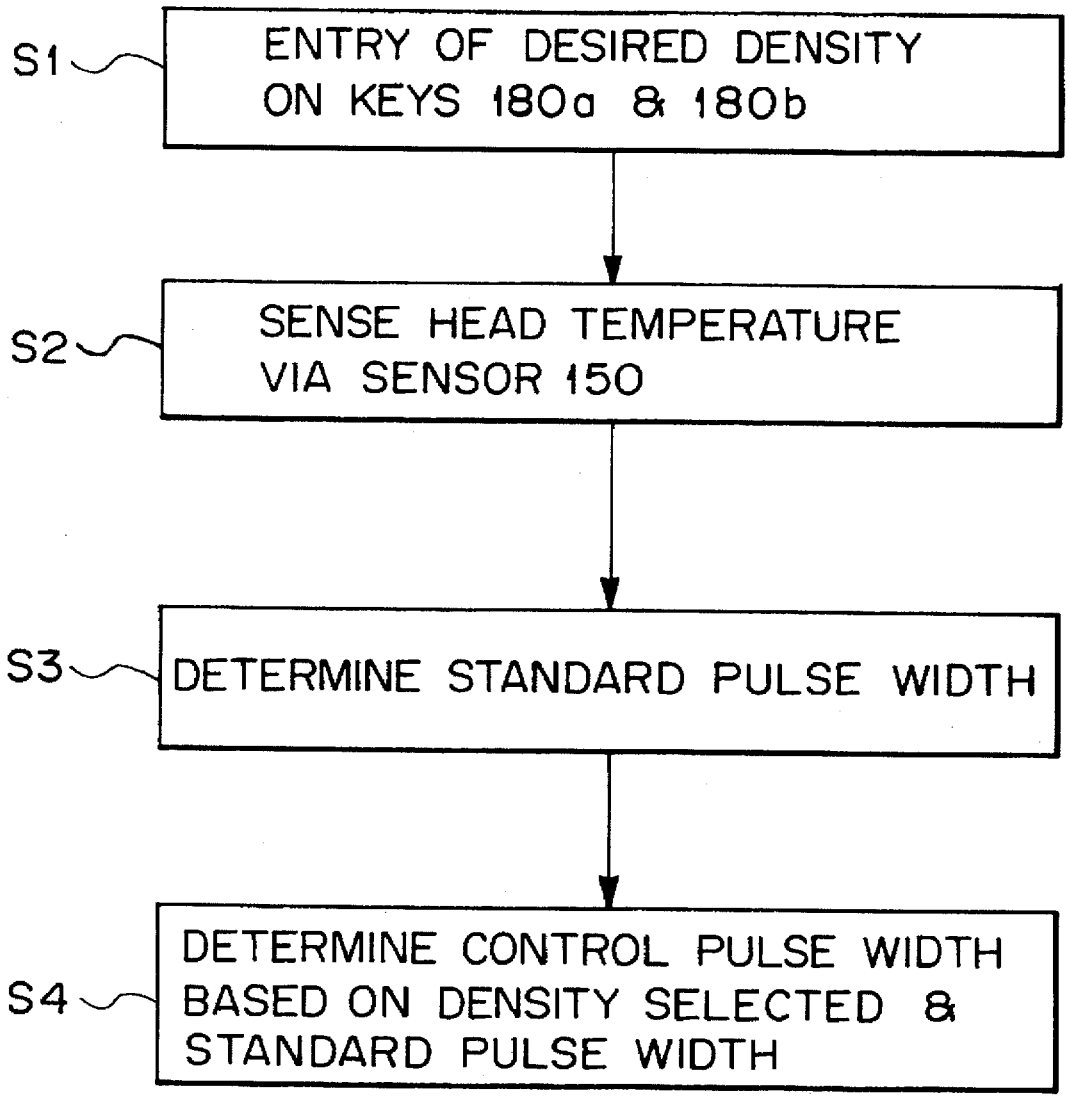
FIG. 8 is a flowchart demonstrating a specific operation of the embodiment shown in FIG. 6.
Figure 9:
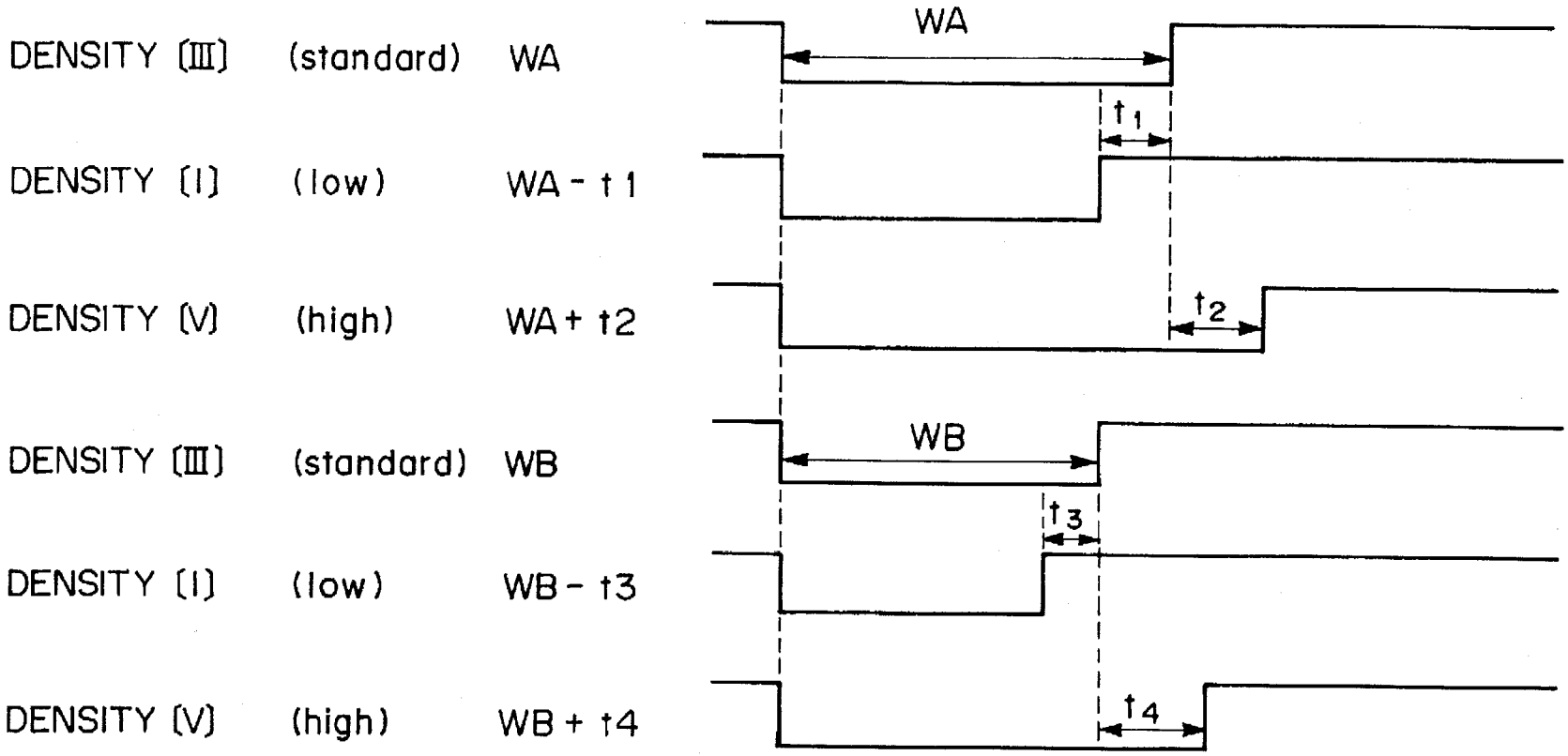
FIG. 9 is a timing chart associated with FIG. 8.

Referring to FIGS. 8 and 9, how the embodiment determines a control pulse width for the head 91 will be described. As shown in FIG. 8, assume that the operator has selected a desired image density from among the five different densities [I] to [V] by operating the keys **180*a* and 180*b* (step S1). The head temperature sensor 150 senses the temperature of the head 91 (step S2). Then, the microprocessor 170*a* determines a standard pulse width associated with the head temperature sensed by the sensor 150. Subsequently, the microprocessor 170*a* calculates, based on the density selected on the keys 180*a* and 180*b* and the standard pulse width, a pulse width to be applied to the head 91**.

A reference will be made to FIG. 9 for describing pulse widths matching head temperatures of A° C. and B° C. by way of example. Assume that the standard pulse width is WA when the head temperature is A° C. When the standard density [III] is selected, the standard pulse width WA is applied; when the lowest density [I] is selected, a pulse width narrower than the pulse width WA, i.e., $(WA-t_1)$ is applied; and when the highest density [V] is selected, a pulse width broader than the pulse width WA, i.e., $(WA+t_2)$ is applied. On the other hand, assume that the pulse width is WB when the head temperature is B° C. Then, when the standard density [III] is selected, the standard pulse width WB is applied; when the lowest density [I] is selected, a pulse width $(WB-t_3)$ is applied; and when the highest density [V] is selected, a pulse width $(WB+t_4)$ is applied. It is to be noted that the standard pulse widths WA and WB, pulse widths $t_1$, $t_2$, $t_3$ and $t_4$ were derived from experiments repeated a number of times.

For experiments, use was made of a 40 μm stencil 61 consisting of a porous substrate implemented by Japanese paper, and a 2 μm thick thermoplastic resin film adhered to the substrate. It was found that when the pulse width is changed in matching relation to the head temperature and density selected, images of desired density are achievable.

With this embodiment, it is possible to use a thermosensitive stencil implemented substantially only by a thermoplastic resin film. When a 2 μm thick stencil of this kind was used and the pulse width was changed in association with head temperature and density selected by the operator, an image of desired density was also successfully produced.

In summary, in accordance with the present invention, a desirable image of constant density is achievable at all times without regard to changes in the temperature and, therefore, fluidity of ink. Since energy for cutting a stencil is corrected to a predetermined energy, the density of printings can be changed surely and easily. To change printing density, conventional arrangements of the kind changing the pressure pressing a sheet against a master mechanically and those of the kind changing printing speed would need changes in mechanical arrangements and even in sequence conditions.

Various modifications will become possible for those skilled in the art after receiving the teachings of the present disclosure without departing from the scope thereof. For example, so long as temperature inside the printer is stable, ink temperature is substantially equal thereto. In such a condition, the above-stated advantages will also be achieved even when temperature inside .the printer is sensed in place of ink temperature. In practice, however, it is difficult to implement density control equivalent to the control of the embodiments since temperature inside the printer usually depends on the usage of the printer and is different from ink temperature. If desired, the embodiments of FIGS. 4 and 6 may be combined in order to effect density control by feeding both the ink temperature and the density selected.

What is claimed is:

1. A device included in a thermosensitive stencil printer for controlling a density of an image to be formed on a sheet by a thermal head in association with a change in a temperature of ink, said device comprising:

ink temperature sensing means for sensing the temperature of the ink and outputting a corresponding ink temperature signal;

head temperature sensing means for sensing a temperature of the thermal head and outputting a corresponding head temperature signal; and control means, receiving said ink temperature signal, and said head temperature signal for adjusting cutting energy being applied to the thermal head according to a predetermined energy, included in said control means, for cutting a thermosensitive stencil in response to the ink temperature signal and the head temperature signal.

2. A device as claimed in claim 1, wherein said ink temperature sensing means and said head temperature sensing means each comprise a thermistor.

3. A device as claimed in claim 2, wherein said control means comprises a microprocessor having a CPU and a ROM.

4. A device as claimed in claim 3, wherein said ROM stores a program for adjusting the cutting energy, and a relation between the temperatures of the ink and thermal head and optimal cutting energy.

5. A device as claimed in claim 4, wherein the cutting energy is adjusted by changing either a current or a voltage to be applied to the thermal head.

6. A device as claimed in claim 4, wherein the cutting energy is adjusted by changing a width of control pulses being applied to the thermal head.

7. A device as claimed in claim 1, wherein a stencil for use with said printer comprises only a thermoplastic resin film.

8. A device as claimed in claim 1, wherein a stencil for use with said printer comprises Japanese paper or similar porous substrate, and a thermoplastic resin film formed on said porous substrate.

9. A device included in a thermosensitive stencil printer for providing an image formed on a sheet by a thermal head with a desired density, said device comprising:

density setting means for outputting a set density signal representative of a value selected for providing the image with the desired density;

head temperature sensing means for sensing a temperature of the thermal head and outputting a corresponding head temperature signal; and control means, receiving said set density signal and said head temperature signal, for adjusting cutting energy being applied to the thermal head to a predetermined energy, included in said control means, for cutting a thermosensitive stencil in response to said set density signal and said head temperature signal.

10. A device as claimed in claim 9, wherein said density setting means comprises two density keys provided on an operation panel included in said printer.

11. A device as claimed in claim 10, wherein said head temperature sensing means comprises a thermistor.

12. A device as claimed in claim 11, wherein said control means comprises a microprocessor having a CPU and a ROM.

13. A device as claimed in claim 12, wherein said ROM stores a program for adjusting the cutting energy, and a relation between the set density and thermal head and optimal cutting energy.

14. A device as claimed in claim 13, wherein the cutting energy is adjusted by changing either a current or a voltage being applied to the thermal head.

15. A device as claimed in claim 13, wherein the cutting energy is adjusted by changing a width of control pulses being applied to the thermal head.

16. A device as claimed in claim 9, wherein a stencil for use with said printer comprises only a thermoplastic resin film.

17. A device as claimed in claim 9, wherein a stencil for use with said printer comprises Japanese paper or similar porous substrate, and a thermoplastic resin film formed on said porous substrate.

* * * * *